US011125442B2

(12) United States Patent
Hanna et al.

(10) Patent No.: US 11,125,442 B2
(45) Date of Patent: Sep. 21, 2021

(54) CONTROL SYSTEM FOR A COOKING APPLIANCE HAVING A GAS BURNER

(71) Applicants: BSH Home Appliances Corporation, Irvine, CA (US); BSH Hausgeräte GmbH, Munich (DE)

(72) Inventors: Charles Hanna, Knoxville, TN (US); David Sumner, Jacksboro, TN (US); Gary Young, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 44 days.

(21) Appl. No.: 16/451,261

(22) Filed: Jun. 25, 2019

(65) Prior Publication Data

US 2020/0408412 A1 Dec. 31, 2020

(51) Int. Cl.

| | |
|---|---|
| ***F24C 3/12*** | (2006.01) |
| ***F24C 15/00*** | (2006.01) |
| ***F04D 27/00*** | (2006.01) |

(52) U.S. Cl.

CPC ..... *F24C 3/124* (2013.01); *F04D 27/004* (2013.01); *F24C 15/006* (2013.01); *F05B 2270/1016* (2013.01); *F05B 2270/303* (2013.01); *F05B 2270/606* (2013.01)

(58) Field of Classification Search

CPC ..... F24C 3/124; F24C 15/006; F04D 27/004

See application file for complete search history.

(56) References Cited

U.S. PATENT DOCUMENTS

| | | | | |
|---|---|---|---|---|
| 7,076,324 | B2 | 7/2006 | Harkcom et al. | |
| 7,866,312 | B2 * | 1/2011 | Erdmann | F24C 3/12 126/299 D |
| 9,215,948 | B2 | 12/2015 | Fetterman et al. | |
| 2010/0163549 | A1 * | 7/2010 | Gagas | F24C 15/2042 219/622 |
| 2012/0132647 | A1 * | 5/2012 | Beverly | H05B 6/062 219/624 |
| 2014/0246009 | A1 * | 9/2014 | Tisselli | F24C 3/08 126/39 E |
| 2015/0323196 | A1 * | 11/2015 | Chadwick | F24C 15/006 126/21 A |
| 2016/0123603 | A1 | 5/2016 | Chen et al. | |
| 2017/0067647 | A1 * | 3/2017 | Wie | F24C 15/006 |
| 2018/0082564 | A1 | 3/2018 | Fang et al. | |
| 2019/0261465 | A1 * | 8/2019 | Meng | G01K 1/143 |
| 2019/0301743 | A1 * | 10/2019 | Cowan | F16K 31/02 |
| 2020/0092958 | A1 * | 3/2020 | Neal | G01P 3/36 |

FOREIGN PATENT DOCUMENTS

| | | |
|---|---|---|
| CN | 105258170 A | 10/2015 |

* cited by examiner

*Primary Examiner* — Vincent H Tran

(74) *Attorney, Agent, or Firm* — Michael E. Tschupp; Andre Pallapies; Brandon G. Braun

(57) ABSTRACT

A control system for a cooking appliance having gas burners is configured to control a speed of one or more cooling fans of the appliance based on information sensed about a position and/or motion of a knob associated with one of the gas burners. The information about the knob position and/or motion may be determined by a rotary monitor and/or any other suitable sensor. In some examples, the control system is further configured to control a gas valve coupled to the burner based on the sensed information about the knob.

20 Claims, 8 Drawing Sheets

CONTROL SYSTEM FOR A COOKING APPLIANCE HAVING A GAS BURNER

FIELD

This disclosure relates to systems and methods for controlling cooking appliances having gas burners.

INTRODUCTION

A gas range or cooktop may include one or more cooling fans to prevent the appliance from overheating. Typically, the fans cool the appliance by drawing air through passage(s) within the appliance (e.g., underneath the cooktop). However, the flow of air within the appliance can adversely affect the pressure of air near the gas burners. Because the gas burners rely on the oxygen in air to produce a flame, the air flow caused by the cooling fans may interfere with the ability of the burners to produce and/or maintain a stable flame. This can lead to a situation wherein a user attempts to activate a burner, but the burner fails to produce a flame. The user therefore may find the appliance difficult and unreliable to use. Furthermore, if gas flows from the burner but fails to ignite due to lack of air, unburned gas tends to collect at the burner, leading to the flareup of a large flame when the gas finally does ignite. Solutions are needed for cooling a gas-burning appliance without disrupting the production and/or maintenance of a flame at the burner.

SUMMARY

The present disclosure provides systems, apparatuses, and methods relating to controls for gas cooktops and ranges.

In some embodiments, a gas cooktop may include: a gas burner; a gas valve controlling a flow of combustible gas to the gas burner; a user interface (UI) element coupled to the gas valve and operable to change a position of the gas valve; and an electronic controller including processing logic configured to adjust a speed of one or more cooling fans based on a sensed state of the user interface element.

In some embodiments, a control system for a gas cooktop may include: a gas burner in communication with a gas valve configured to throttle a supply of combustible gas to the gas burner; a user interface element coupled to the gas valve and operable to change a position of the gas valve; a sensor configured to sense a state of the user interface element; a controller coupled to the sensor and including processing logic configured to adjust a speed of one or more cooling fans based on the state of the user interface element.

In some embodiments, a method for operating a gas cooktop may include: receiving, by a controller, information corresponding to a state of a user interface (UI) element, wherein the UI element is configured to control a gas valve coupled to a gas burner of a gas range; based on the state of the UI element, adjusting a position of the gas valve; based on the state of the UI element, adjusting a speed of one or more cooling fans coupled to the gas range.

Features, functions, and advantages may be achieved independently in various embodiments of the present disclosure, or may be combined in yet other embodiments, further details of which can be seen with reference to the following description and drawings.

DETAILED DESCRIPTION

Figure 1:
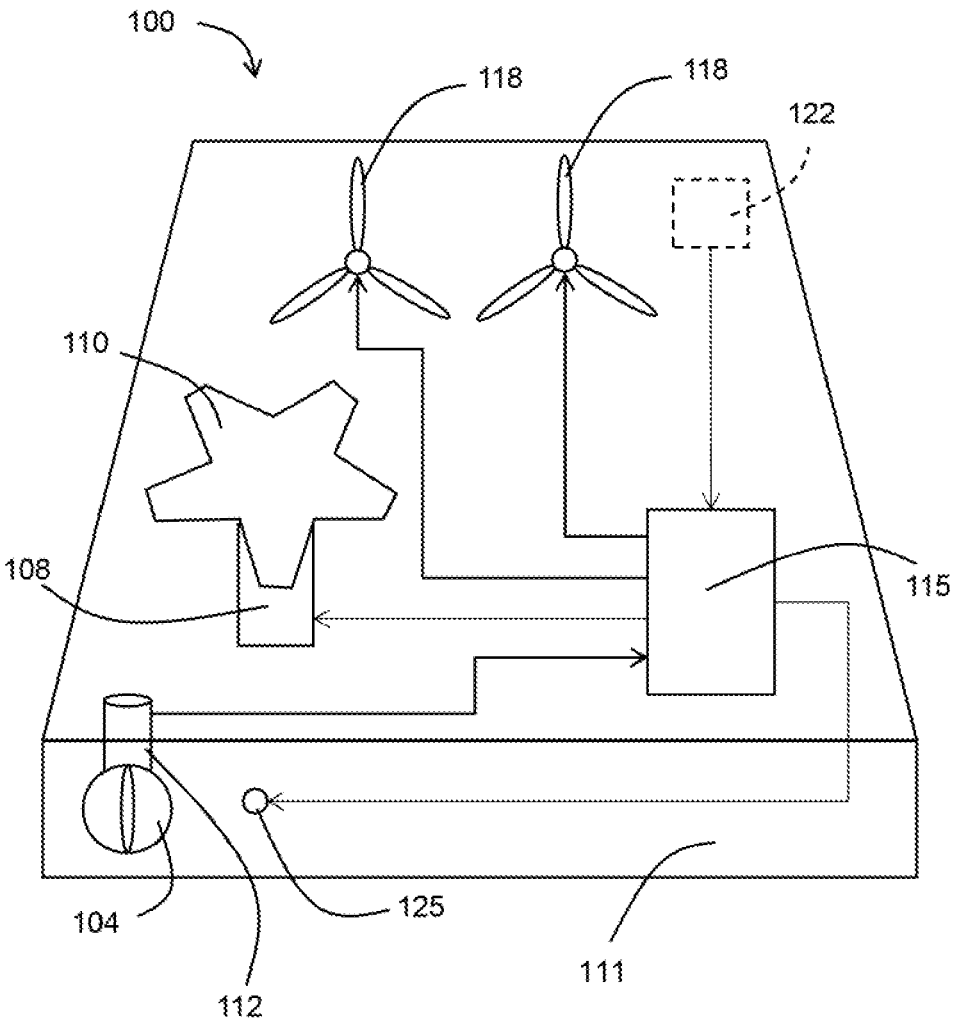
FIG. 1 is a schematic diagram of an illustrative control system according to aspects of the present teachings.

Various aspects and examples of a cooktop control system, as well as related methods, are described below and illustrated in the associated drawings. Unless otherwise specified, a control system in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections A through D, each of which is labeled accordingly.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"Coupled" means connected, either permanently or releasably, whether directly or indirectly through intervening components.

"Processing logic" means any suitable device(s) or hardware configured to process data by performing one or more logical and/or arithmetic operations (e.g., executing coded instructions). For example, processing logic may include one or more processors (e.g., central processing units (CPUs) and/or graphics processing units (GPUs)), microprocessors, clusters of processing cores, FPGAs (field-programmable gate arrays), artificial intelligence (AI) accelerators, digital signal processors (DSPs), and/or any other suitable combination of logic hardware.

Overview

In general, a control system for a cooking appliance in accordance with aspects of the present teachings is configured to control one or more cooling fans based at least partially on information about the state, position, and/or movement of knob(s) or other suitable user interface (UI) devices configured to control burner(s) of the appliance. The cooking appliance comprises a gas range or cooktop having at least one gas burner, and the control system is configured to control at least one fan in a manner that reduces the likelihood that the fan will interfere with the burning of gas at the burner. For example, if the burner is operating in a mode wherein gas pressure at the burner is very low, a cooling fan drawing air rapidly through the appliance tends to create a negative pressure within the cooktop, thereby drawing air out of the cooktop. In this manner, the cooling fan may deprive the burner of the oxygen needed to produce a flame. To prevent this problem, the control system of the present teachings senses that the burner is operating in a low-pressure mode (e.g., by sensing that the burner knob is positioned at a state corresponding to a low burner setting) and, in response, lowers the fan speed at least temporarily to prevent the fan from depriving the burner of air.

More generally, information sensed about the burner control UI (e.g., knob) may indicate a burner setting, or change in setting, at which an adjustment to the fan speed is likely to facilitate flame production. The sensed information may comprise a setting of the burner (e.g., a low setting configured to produce a small or intermittent flame, a high setting configured to produce a large flame, etc.), a change in the position or state of the knob (e.g., an increase or decrease in flame production, a rate of change of flame production, etc.), and/or any other suitable information.

An illustrative control system 100 in accordance with aspects of the present teachings is depicted in FIG. 1. A knob 104 is configured to actuate a valve 108 controlling flow of gas (e.g., natural gas, propane, and/or any other suitable gas) to a burner 110 of a cooking appliance 111 (e.g., a gas range, gas cooktop, and/or any other suitable appliance). A sensor 112 is configured to sense information about the state and/or operation of knob 104. In some examples, the sensed information is related to a position of the knob (corresponding, e.g., to a high burner setting, low burner setting, etc.). Additionally, or alternatively, the sensed information may be related to a direction and/or speed of rotation of the knob (indicating, e.g., whether supply of gas to the burner is increasing or decreasing, and/or how quickly the supply is increasing or decreasing). The sensor may comprise any suitable device configured to obtain the appropriate information about the knob. For example, the sensor may comprise an encoder, a variable resistor, a Hall sensor, and/or any other suitable sensor configured to detect an angular position, angular speed, angular displacement, and/or direction of angular displacement. In some examples, sensor 112 may comprise multiple sensors (e.g., a sensor configured to sense position and a sensor configured to sense angular speed). Although a manually-controlled knob is depicted and described herein, knob 104 may be replaced or supplemented with any suitable user interface, such as a touch control, slider, voice control, or the like. In some examples, the user interface may be controllable remotely, such as by way of a software application running on a user's mobile electronic device. In some examples, the user interface may be controllable by an onboard microcontroller or other system integrated into the cooking appliance.

A controller 115 is configured to receive sensed information from sensor 112 and to adjust a speed of one or more fans 118 based on the received information. For example, if the received information indicates that gas pressure at burner 110 is very low, then controller 115 may at least temporarily stop or slow fan 118 to reduce the likelihood that air flow caused by the fan will interfere with the flame at the burner. In examples where more than one fan 118 is present, controller 115 may be configured to control the fans independently (e.g., based on a likelihood that each fan will disrupt the flame at burner 110). For example, controller 115 may reduce the speed of a fan nearer the burner by a greater amount than the speed of a fan farther from the burner. Controller 115 may comprise one or more processors and/or any other suitable processing logic.

In conventional gas cooktops or ranges, the knob used to adjust the burner setting is mechanically coupled to the valve that controls gas flow to the burner, such that adjusting the knob directly adjusts the valve. In contrast, in system 100, knob 104 and valve 108 may be mechanically decoupled, with controller 115 configured to adjust the valve based on the information sensed about the knob by sensor 112. That is, knob 104 and valve 108 are coupled electronically rather than mechanically. Coupling the knob to the gas valve electronically rather than mechanically may simplify the design of the cooking appliance (e.g., by reducing or removing constraints on the location and/or alignment of the valve and knob). However, in some examples, knob 104 and valve 108 are coupled mechanically rather than, or in addition to, electronically.

In some examples, system 100 further includes one or more temperature sensors 122, and controller 115 is configured to receive temperature information from the temperature sensor(s) and to adjust the speed of one or more fans 118 based at least partially on the received temperature information. Temperature sensor(s) 122 may be disposed in or on the cooktop chassis, on a back wall of the appliance, adjacent the appliance, and/or in any other suitable location. Controller 115 may be configured, e.g., to activate a fan and/or increase fan speed in response to high temperature readings, to cool the high-temperature area. Additionally, or alternatively, controller 115 may be configured to deactivate a fan and/or reduce fan speed in response to lower temperature readings, to save energy and/or to reduce sound.

In some examples, controller 115 is further configured to control one or more indicators 125 of the cooking appliance based on information sensed by sensor 112. Indicator 125 typically comprises one or more lights (e.g., LEDs, incandescent lights, etc.), display screens (e.g., LCDs and/or the like), audible alerts, and/or any other human-perceptible signal configured to alert a user to the status of the appliance (e.g., of burner 110). For example, indicator 125 may comprise an LED, and controller 115 may be configured to turn on the LED in response to information from sensor 112 indicating that burner 110 is on (e.g., that knob 104 is in a position associated with gas flow at the burner), and to turn off the LED in response to information indicating that the burner is off.

In some examples, indicator 125 is configured to display information relating to the setting of the burner. For example, indicator 125 may comprise a light bar (e.g., a discrete or continuous row of lights) configured to be illuminated along some or all of its length, and the length of the light bar illuminated may be determined by the burner setting. For example, controller 115 may indicate a high burner setting by illuminating a large portion of the light bar and may indicate a low burner setting by illuminating a small portion of the light bar.

Although the control system of the present disclosure is described above primarily in the context of a gas range or cooktop, system 100 may additionally or alternatively be used in conjunction with any other suitable appliance. Examples of suitable appliances may include ovens, grills, smokers, and/or the like.

Examples, Components, and Alternatives

The following sections describe selected aspects of exemplary control systems configured to control a fan based on the state of a burner control interface, as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Cooking Appliance

As shown in FIGS. 2-6, this section describes an illustrative appliance 200. Appliance 200 is an example of a cooking appliance having gas burners and a control system configured to control one or more fans based at least partially on sensed information relating to a burner control knob, as described above.

Figure 2:
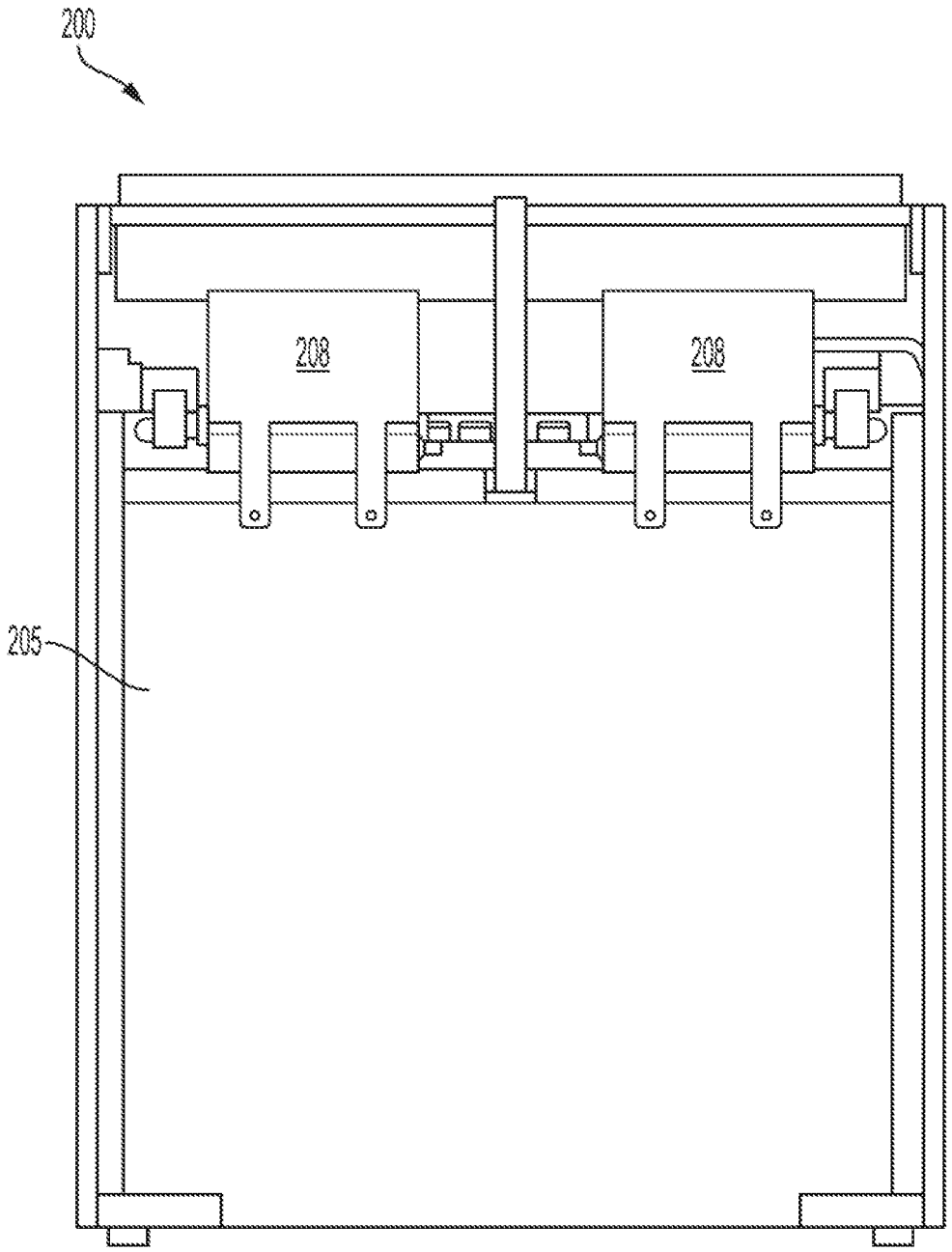
FIG. 2 is a back view of an illustrative cooking appliance in accordance with aspects of the present teachings.

FIG. 2 is a rear view of appliance 200, depicting a back portion 205 of the appliance. Two fans 208 are disposed adjacent back portion 205. Fans 208 comprise centrifugal fans, but in other examples, the fans may comprise axial fans and/or any other suitable air-moving device, and more or fewer than two fans may be provided. Fans 208 are configured to cool appliance 200 by creating a suitable air flow, as described below.

Figure 3:
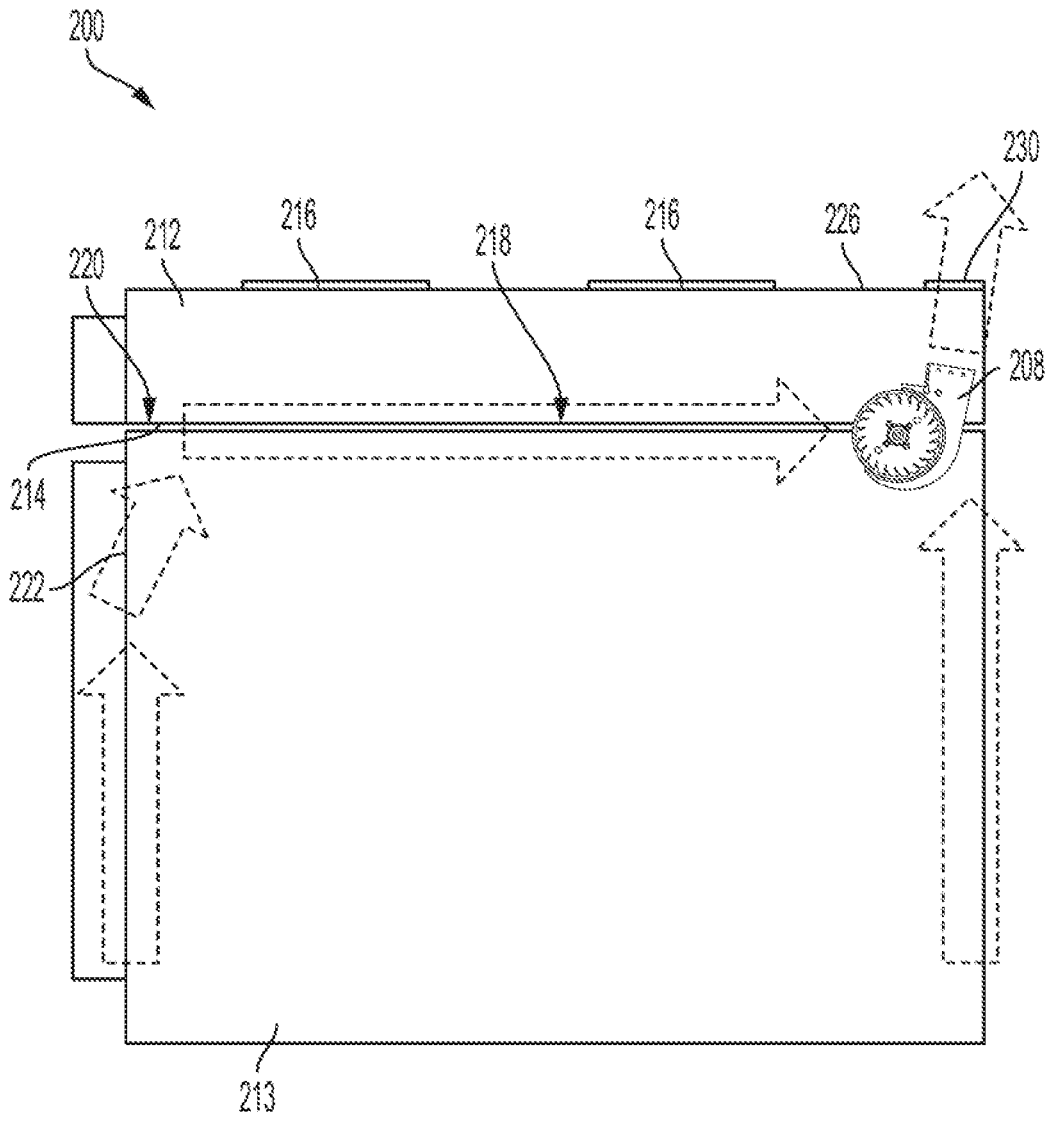
FIG. 3 is a side view depicting air flow within the appliance of FIG. 2.

FIG. 3 is a side view of appliance 200, schematically depicting air flow through the appliance caused by operation of fans 208. As FIG. 3 shows, appliance 200 comprises a cooktop chassis 212 disposed above an oven 213. Gas burners 216 are disposed at an upper portion of cooktop chassis 212. A passage 214 disposed underneath a floor 218 of chassis 212 has a front opening 220 within front portion 222 of appliance 200. Passage 214 extends to (or nearly to) back portion 205. Passage 214 is in communication with at least one vent 230 disposed within a top portion 226 of the appliance. Fans 208 are each configured to draw air from passage 214 out through vent 230. The air drawn by fans 208 from passage 214 is replaced by air entering the passage through front opening 220 and/or from a lower area of back portion 205. In this manner, air that has been heated inside appliance 200 (e.g., due to heating by one or more burners 216 and/or oven 213) is exhausted from the appliance and replaced with air that is typically cooler.

Figure 4:
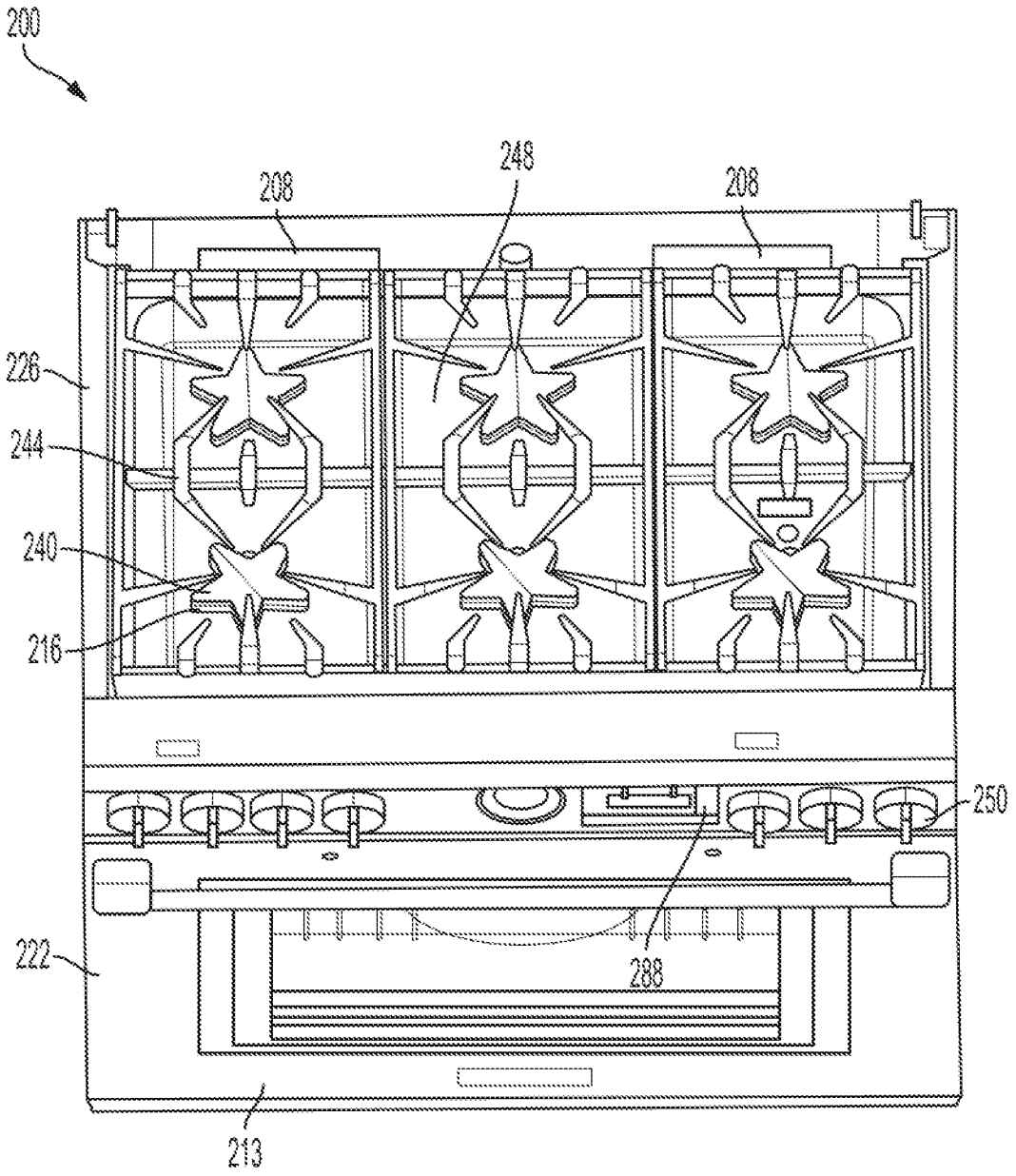
FIG. 4 is a top front view of the appliance of FIG. 2.

FIG. 4 is a top front view of appliance 200 depicting top portion 226 and front portion 222 of the appliance. Burner caps 240 of burners 216 are disposed at top portion 226. A grate 244 is configured to support cookware above burner caps 240 to facilitate cooking food items in the cookware. A range top surface 248 is disposed underneath burner caps 240 to protect the interior of cooktop chassis 212 from food spills and other hazards. Burner control knobs 250, each configured to allow a user to adjust a setting of each burner, are disposed in an upper region of front portion 222 of the appliance. In the example depicted in FIG. 4, appliance 200 includes six burners 216, but in other examples, the appliance may include more or fewer burners. Additional control devices such as knobs, switches, and/or the like may be included to enable control of the oven, to enable or disable gas flow to the appliance, and/or any other suitable functions.

Figure 5:
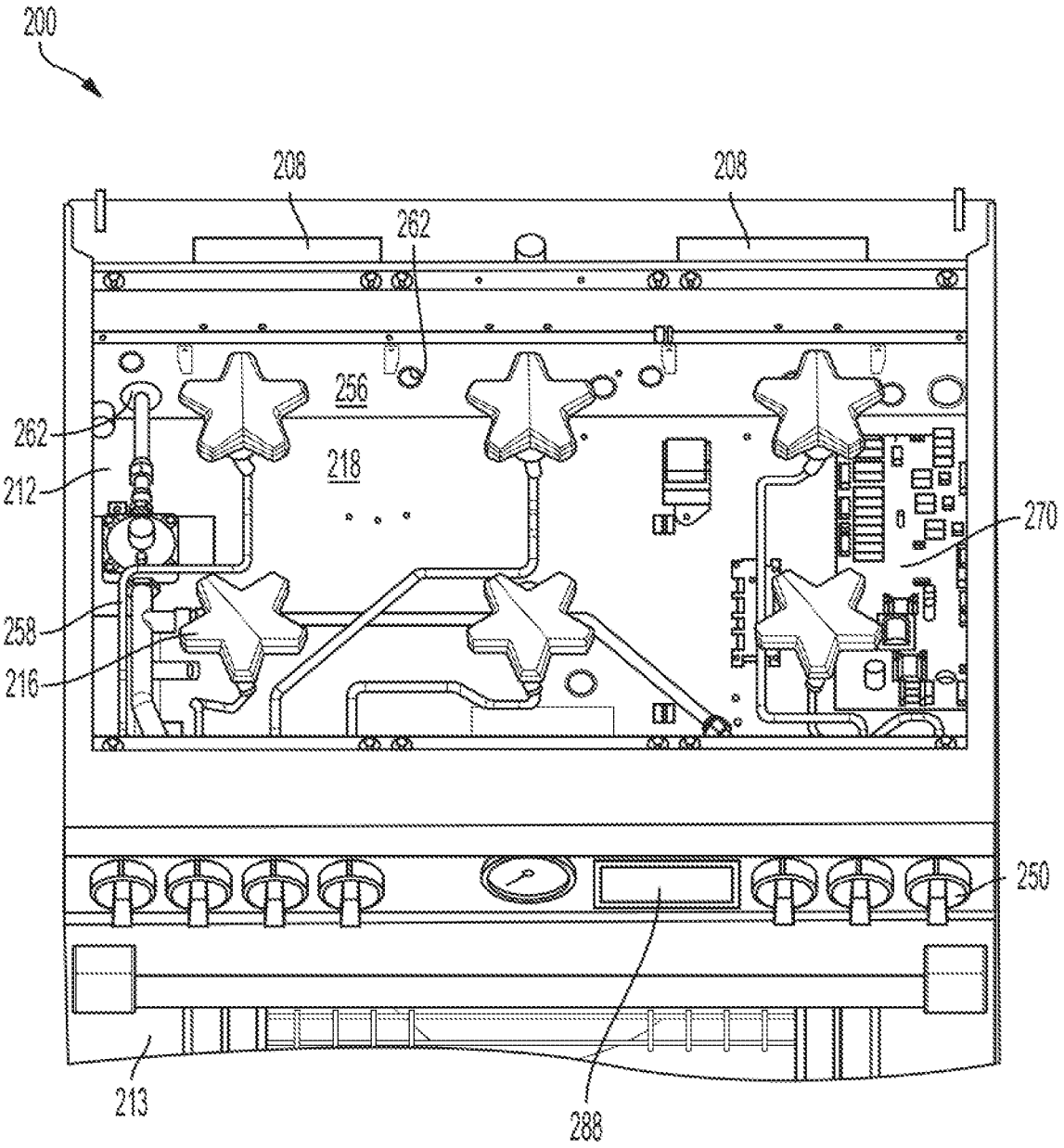
FIG. 5 is another top front view of the appliance of FIG. 2 with a top portion omitted to show an illustrative cooktop chassis.

FIG. 5 is another top front view of appliance 200, with range top surface 248 omitted to show the interior of chassis 212. Chassis 212 comprises chassis walls 256 and chassis floor 218. As described above, passage 214 (not shown) is disposed underneath chassis floor 218. A pipe system 258 disposed within chassis 212 is configured to supply gas to burners 216 via respective valves associated with each burner (see FIG. 6). Additional valves, regulators, and/or any other suitable component(s) may be provided as needed.

At least one of the chassis walls 256 includes one or more openings 262 configured to allow pipes 258 to enter chassis 212 (e.g., to convey gas to burners 216 from a gas supply exterior to appliance 200). As described above, openings 262 allow air to be drawn out of chassis 212 in response to a negative pressure created by fans 208. This creates an air current and reduces the amount of oxygen available to burners 216, and thus tends to reduce the ability of the burners to produce and/or maintain a stable flame. Control board 270, disposed inside chassis 212, is an example of controller 115, and may be configured to alleviate this problem as described above.

Figure 6:
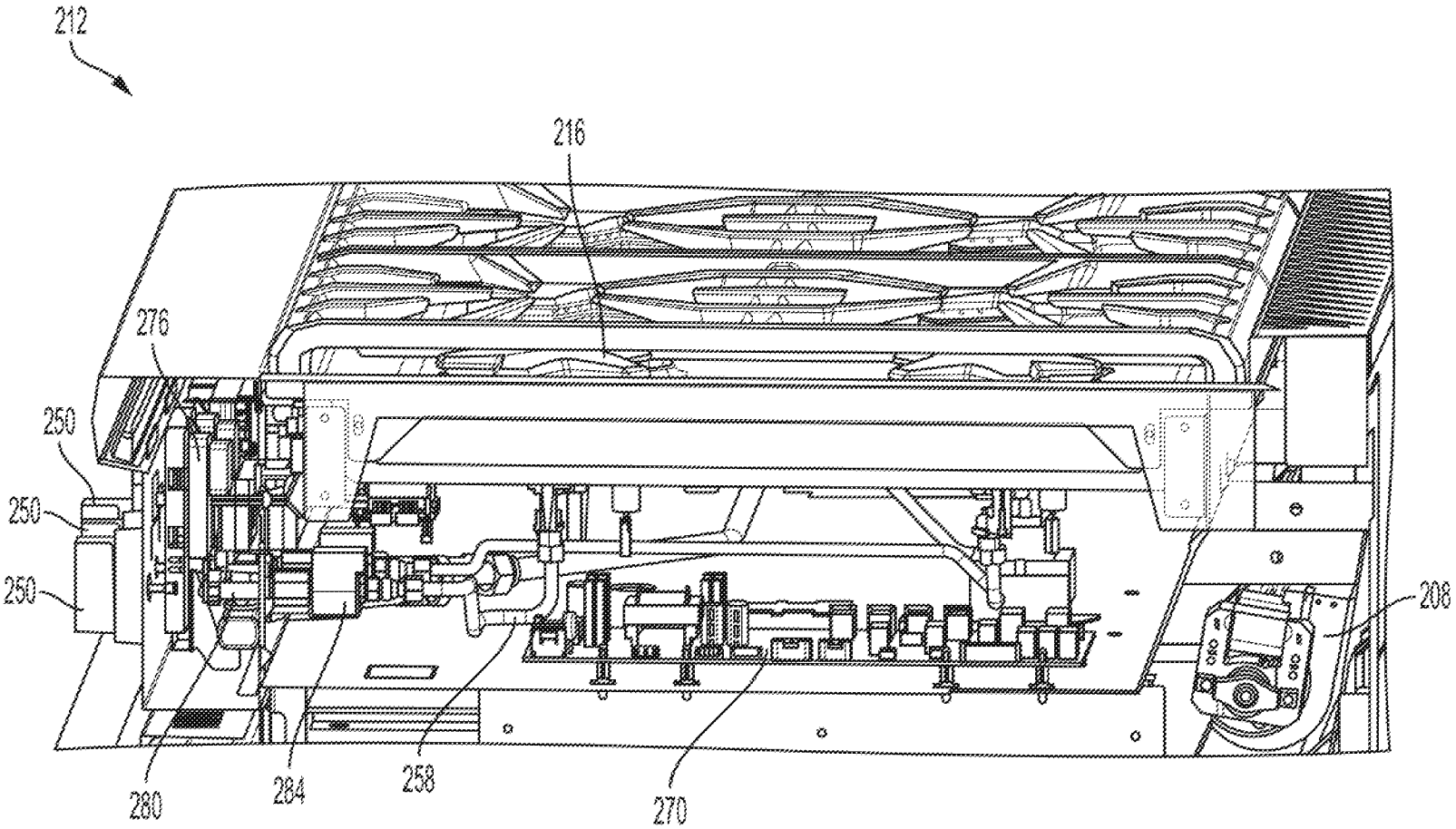
FIG. 6 is a sectional view of the cooktop chassis of FIG. 5.

FIG. 6 is a sectional side view of chassis 212. FIG. 6 depicts several burner knobs 250. A respective rotary sensor 276 associated with each burner knob 250 is disposed inside chassis 212 and configured to sense an angular position, speed of rotation, and/or direction of rotation of the associated knob. Control board 270 is configured to receive from sensor 276 data representing the sensed position and/or rotation characteristic(s). The data may be transmitted wirelessly, by one or more wires or other suitable electrical conductors, and/or by any other suitable mechanism.

In response to the data received from sensor 276, control board 270 transmits a signal to a valve 280 configured to control a flow of gas from pipes 258 to burner 216. In the example depicted in FIG. 6, valve 280 includes a solenoid 284. Solenoid 284 may be configured to open/close (e.g., throttle) valve 280 to a selected extent (e.g., in response to a signal from control board 270 and/or any other suitable control device, based on a setting of knob 250, or on any other suitable basis) to enable a desired gas flow to burner 216. Additionally, or alternatively, solenoid 284 may be configured as a safety shutoff, e.g., configured to hold valve 280 open until the solenoid receives a suitable signal, loses power, etc. In some examples, however, solenoid 284 is omitted.

Control board 270 is further configured, in response to receiving data from knob sensor 276, to control fans 208. Control board 270 may send a signal to fans 208 to increase or decrease the speed of the fans, and/or stop or start the fans, as appropriate. For example, control board 270 may receive directional information from knob sensor 276 indicating that burner 216 is being turned from a very low setting to a high setting. In response, control board 270 may reduce the speed of fans 208 during the time interval in which knob 250 is being turned from the low-setting position to the high-setting position. The reduced fan speed allows a flame to grow at the burner as the knob is adjusted (and correspondingly, valve 280 is adjusted by control board 270 and/or another control device (e.g., a voltage regulator), adjusted automatically due to a mechanical coupling between the knob and the valve, and/or is adjusted in any other suitable way).

Control board 270 (which may include a controller or microcontroller) may transmit signals to fans 208 wirelessly and/or via electrical conductors and/or any other suitable mechanism. If appliance 200 includes more than one fan 208, control board 270 may be configured to communicate independently with each of the fans. Based on its position on appliance 200, a given fan 208 may affect air flow differently in different parts of chassis 212. For example, fan 208 may draw more air from regions of chassis 212 nearer the fan as opposed to from regions of the chassis farther from the fan. Accordingly, in response to sensing adjustment of a particular burner, control board 270 may reduce the speed of fan(s) near that burner by a greater amount than the speed of fan(s) farther from that burner.

Control board 270 may be further configured to receive temperature information from a temperature sensor disposed in or adjacent to appliance 200. Based on the sensed temperature information, control board 270 may activate, deactivate, and/or adjust the speed of one or more fans 208. For example, in response to receiving a sensed temperature above a predetermined threshold, control board 270 may be configured to increase a speed of one or more fans, in some cases based on the proximity of the fans to the location of the temperature sensor. Alternatively, or additionally, control board 270 may be configured to reduce the speed of one or more fans in response to receiving temperature data representing a temperature below a predetermined temperature level. This temperature control may be implemented as a thermostat feature, either in hardware, software, or a combination thereof.

In some examples, control board 270 is further configured to transmit information to a display 288 (see FIGS. 4-5) of appliance 200. The information transmitted to the display may include, e.g., information about the setting of one or more burners 216 determined from the corresponding burner knob sensors 276. Additionally, or alternatively, the transmitted information may include an indication of the fan speed set by control board 270, temperature information received by the control board, and/or any other suitable information.

B. First Illustrative Method for Controlling a Gas Burner

Figure 7:
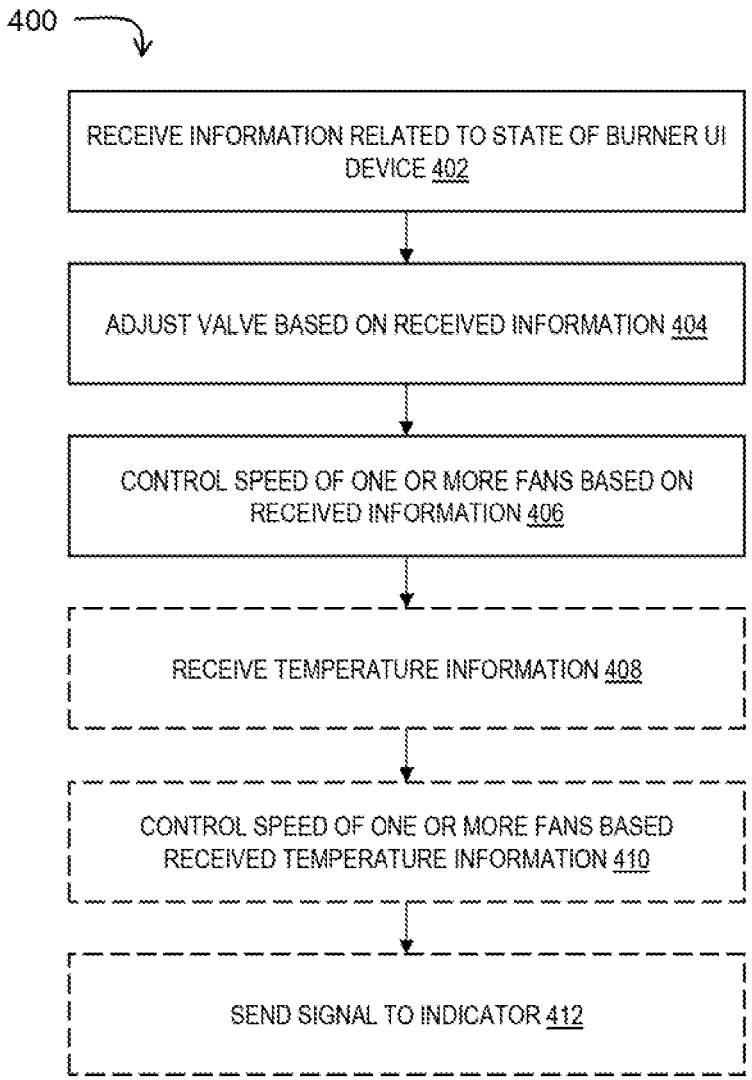
FIG. 7 is a flow chart depicting steps of an illustrative method for controlling a gas burner according to the present teachings.

This section describes steps of an illustrative method 400 for controlling a gas burner in a cooking appliance having at least one cooling fan; see FIG. 7. Aspects of control system 100 and/or appliance 200 may be utilized in the method steps described below. Where appropriate, reference may be made to components and systems that may be used in carrying out each step. These references are for illustration, and are not intended to limit the possible ways of carrying out any particular step of the method.

FIG. 7 is a flowchart illustrating steps performed in an illustrative method, and may not recite the complete process or all steps of the method. Although various steps of method 400 are described below and depicted in FIG. 7, the steps need not necessarily all be performed, and in some cases may be performed simultaneously or in a different order than the order shown.

At step 402, method 400 includes receiving, by an electronic controller, information related to a position and/or adjustment of a gas burner user interface (UI) device. In some examples, the UI device comprises a knob rotatable between a plurality of continuous or discrete positions corresponding to a setting of the burner. The burner setting is typically associated with a size of a flame to be produced at the burner. The flame size is at least partially determined by an amount of gas (e.g., volumetric flow rate) flowing from an orifice of the burner, as described below with reference to step 404. In some examples, the available burner settings additionally or alternatively include settings wherein the flame is cycled on and off at predetermined intervals (e.g., to achieve a low cooking temperature). The information received by the controller about the knob may include a position of the knob (corresponding to the selected burner setting), a speed of rotation of the knob (corresponding to a speed with which the burner setting is being changed), a direction of rotation of the knob (corresponding, e.g., to whether the burner heat and/or flame is being increased or decreased), and/or any other suitable information indicating the burner setting and/or an adjustment thereto. Any suitable sensor may be used to acquire the information relating to the burner knob. For example, a rotary monitor having one or more Hall sensors may be used to determine the knob's position, speed of rotation, etc.

At step 404, method 400 includes adjusting, based on the received information about the burner knob, a valve configured to control the flow of gas to the burner. In some examples, the adjustment is performed by the electronic controller. In other words, in these examples, the desired burner setting is indicated by a position of the burner knob, the controller receives data representing the burner setting from the sensor at step 402, and at step 404, the controller adjusts the burner valve to enable a gas flow appropriate to the indicated burner setting. For example, if the burner setting corresponds to a high heat, the controller typically adjusts the valve to allow a relatively high gas flow to produce a relatively large flame. In other examples, the valve may be adjusted by another controller, such as a remote controller communicating wirelessly with the valve, another controller of the appliance, etc. In yet other examples, the valve may be mechanically coupled to the burner knob or other UI device, such that adjusting the knob directly adjusts the valve.

At step 406, method 400 includes controlling, by the electronic controller, a speed of one or more fans based on the received information about the burner knob. The fans are typically cooling fans disposed at a back side of the appliance, and/or at any other suitable location. Controlling the fan speed typically includes setting the fan speed to a desired speed selected, at least in part, to reduce the likelihood that air flow within the appliance will affect the presence of air near the burner in a manner that interferes with flame production at the burner. For example, a fan rotating at a relatively high speed may cause a relatively fast flow of air through the appliance, which can draw air away from the burners and thus prevent the burners from producing a flame. Air flow caused by the fan(s) may be particularly likely to adversely impact flame production and/or stability in certain situations. These situations may include, without limitation, a burner being at a low setting and/or any other setting corresponding to a low gas pressure at the burner, a burner being turned from a low setting to a high setting, a burner being at a setting wherein the burner flame is cycled on and/off, a burner in the process of being sparked or otherwise lit, and/or any other suitable situation. Accordingly, in response to information from the burner knob sensor indicating that the burner is likely to be in a situation wherein flame production is threatened by the fan, the electronic controller may slow and/or stop the fan.

In some examples, the fan is stopped or slowed for a predetermined period of time. Alternatively, or additionally, the fan may be stopped or slowed until information is received from the burner knob sensor indicating that the burner flame is in a less vulnerable state.

Controlling the fan speed may include comparing the sensed burner knob position, speed of rotation, and/or direction of rotation to one or more predetermined setpoint or threshold values stored in a memory of the electronic controller. For example, if the burner knob position is determined to be within a predetermined angular range, the controller may set the fan speed to a predetermined level.

In some examples, the controller is configured to change the fan speed at a rate that depends on the speed of rotation of the burner knob, as sensed by the burner knob sensor. For example, if the sensor indicates that the burner knob is being rotated quickly, the controller may adjust the fan speed rapidly (e.g., the fan speed may be changed from a first speed to a second speed over a short interval of time).

The controller may control the fan speed by sending an appropriate instruction to a control unit of the fan, by directly changing a voltage and/or current supplied to the fan, and/or by any other suitable method. In examples wherein the appliance includes two or more fans, each fan may be controllable independently by the controller.

At step 408, the method optionally includes receiving, by the controller, temperature information from one or more temperature sensors disposed in or adjacent the appliance. At step 410, the method optionally includes controlling, by the controller, the speed of the one or more cooling fans based on the received temperature information. For example, the fan speed may be increased if the temperature information indicates that the temperature of one or more portions of the appliance or its environment is above a predetermined threshold, and may be decreased if the temperature indicates a temperature below a predetermined level.

In examples wherein step 408 is performed, the temperature information received by the controller and the burner knob information received by the controller may conflict. For example, the temperature information may indicate that the fan speed should be increased to cool the appliance, and the burner knob information may indicate that the fan speed should be decreased to avoid extinguishing a flame. Such a conflict may be resolved in any suitable manner (e.g., by selecting the fan speed based on the temperature information alone or based on the burner knob information alone, by selecting a fan speed that is in between these speeds, etc.).

At step 412, the method optionally includes sending, by the controller, a signal to an indicator of the appliance configured to cause the indicator to output information about the burner setting. For example, the indicator may output information indicating whether the burner is on or off, at a high or low setting, and/or any other suitable information.

C. Second Illustrative Method for Controlling a Gas Burner

Figure 8:
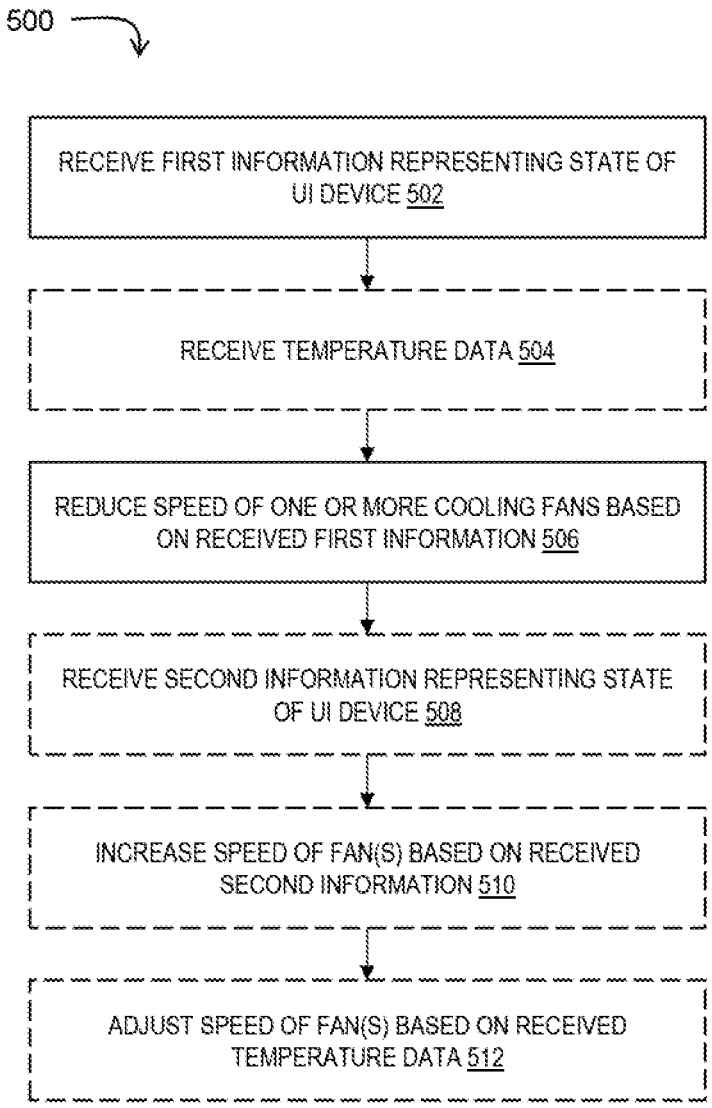
FIG. 8 is a flow chart depicting steps of another illustrative method for controlling a gas burner according to the present teachings.

This section describes steps of an illustrative method 500 for controlling a gas burner of a cooking appliance; see FIG. 8. Aspects of control system 100 and/or appliance 200 may be utilized in the method steps described below. Where appropriate, reference may be made to components and systems that may be used in carrying out each step. These references are for illustration, and are not intended to limit the possible ways of carrying out any particular step of the method.

FIG. 8 is a flowchart illustrating steps performed in an illustrative method, and may not recite the complete process or all steps of the method. Although various steps of method 500 are described below and depicted in FIG. 8, the steps need not necessarily all be performed, and in some cases may be performed simultaneously or in a different order than the order shown.

At step 502, method 500 includes receiving, by an electronic controller, first information representing a state (e.g., a position and/or movement) of a knob (or other suitable UI device) associated with a gas burner of a cooking appliance. The knob allows a user to select a desired setting (e.g., heat level) for the burner. The first information about the knob position or movement is sensed by a rotary sensor or other suitable device.

In some examples, the knob is mechanically coupled to a valve controlling gas flow to the burner, and turning the knob directly adjusts the valve. In other examples, the knob and valve are mechanically decoupled, and the electronic controller or another suitable mechanism (e.g., a voltage regulator) adjusts the valve based on information received from the rotary sensor (and/or the knob).

The electronic controller is typically disposed within or on the cooking appliance. For example, the electronic controller may be disposed within a cooktop chassis. In some examples, however, the electronic controller is remote from the appliance and configured to communicate wirelessly with the appliance.

In some examples, the cooking appliance is manufactured with the electronic controller included. Alternatively, or additionally, the electronic controller may be added to an existing cooking appliance after manufacture.

At step 504, method 500 optionally includes receiving, with the electronic controller, temperature data from one or more temperature sensors. The temperature sensors may be disposed within the appliance, on an exterior surface of the appliance, or near the appliance (e.g., on a wall of a room containing the appliance).

At step 506, method 500 includes, in response to the received first information, reducing a speed of one or more cooling fans based on the information representing the knob position and/or motion. The speed is reduced by the electronic controller, which is configured to send an appropriate electrical signal to the one or more fans in response to the first information. Reducing the fan speed may include stopping the fan completely (e.g., reducing the speed to zero). Reducing the fan speed may allow a flame to be produced at the burner that would otherwise tend to be extinguished, or fail to ignite, due to a lack of oxygen caused by air flow induced in the appliance by the fan.

At step 508, method 500 optionally includes receiving, by the electronic controller, second information representing the knob state. At step 510, method 500 optionally includes increasing the speed of the one or more fans in response to receiving the second information.

At step 512, the method optionally includes adjusting the fan speed based on the temperature data received at step 504. For example, if the temperature information indicates that a portion of the appliance or its environment is in danger of overheating, the fan speed may be increased. As another example, if the temperature information indicates that the appliance and surroundings are far from overheating, the fan speed may be reduced. In some examples, step 512 is performable at any time (e.g., relative to the other steps of the method). In other examples, the controller is configured to refrain from performing step 512 while the fan is operating at a reduced speed in response to the first information (at step 506).

D. Illustrative Combinations and Additional Examples

This section describes additional aspects and features of cooking appliance control systems, presented without limitation as a series of paragraphs, some or all of which may be alphanumerically designated for clarity and efficiency. Each of these paragraphs can be combined with one or more other paragraphs, and/or with disclosure from elsewhere in this application in any suitable manner. Some of the paragraphs below expressly refer to and further limit other paragraphs, providing without limitation examples of some of the suitable combinations.

A0. A control system for a gas cooktop, the system comprising:

a gas burner in communication with a gas valve configured to throttle a supply of combustible gas to the gas burner;

a user interface element coupled to the gas valve and operable to change a position of the gas valve;

a sensor configured to sense a state of the user interface element;

a controller coupled to the sensor and including processing logic configured to adjust a speed of one or more cooling fans based on the state of the user interface element.

A1. The system of A0, wherein the gas valve comprises a solenoid valve.

A2. The system of A0 or A1, wherein the user interface element comprises a rotary knob.

A3. The system of A2, wherein the rotary knob comprises a potentiometer.

A4. The system of A2, wherein the rotary knob is mechanically coupled to the gas valve.

A5. The system of A2, wherein the rotary knob controls a digital output signal.

A6. The system of A0 or A1, wherein the user interface element comprises a touch screen.

A7. The system of any one of paragraphs A0 through A6, wherein the one or more cooling fans are mounted to a range comprising the gas cooktop.

A8. The system of any one of paragraphs A0 through A7, wherein the one or more cooling fans are centrifugal fans.

A9. The system of any one of paragraphs A0 through A8, wherein the processing logic is further configured to adjust the speed of the one or more cooling fans based on a sensed temperature.

A10. The system of any one of paragraphs A0 through A9, wherein the sensed state of the user interface comprises a position indicated by the user interface.

A11. The system of any one of paragraphs A0 through A10, wherein the sensed state of the user interface comprises directional information.

A12. The system of any one of paragraphs A0 through A11, wherein the sensed state of the user interface comprises a speed of change from one position to another position.

B0. A method for operating a gas cooktop, the method comprising:

receiving, by a controller, information corresponding to a state of a user interface (UI) element, wherein the UI element is configured to control a gas valve coupled to a gas burner of a gas range;

based on the state of the UI element, adjusting a position of the gas valve;

based on the state of the UI element, adjusting a speed of one or more cooling fans coupled to the gas range.

B1. The method of B0, further comprising adjusting the speed of the one or more cooling fans based on a sensed temperature.

B2. The method of B0 or B1, wherein the state of the UI element comprises a setting of the UI element.

B3. The method of B2, wherein the state of the UI element comprises a physical position.

B4. The method of any one of paragraphs B0 through B3, wherein the state of the UI element comprises directional information.

B5. The method of any one of paragraphs B0 through B4, wherein the UI element comprises a mechanical knob.

B6. The method of B3, wherein the state of the UI element comprises a speed of rotation of the mechanical knob.

B7. The method of any one of paragraphs B0 through B6, wherein adjusting the position of the gas valve includes adjusting a voltage applied to a solenoid of the gas valve.

C0. A gas cooktop comprising:

a gas burner;

a gas valve controlling a flow of combustible gas to the gas burner;

a user interface (UI) element coupled to the gas valve and operable to change a position of the gas valve; and an electronic controller including processing logic configured to adjust a speed of one or more cooling fans based on a sensed state of the user interface element.

C1. The gas cooktop of C0, wherein the gas valve comprises a solenoid valve.

C2. The gas cooktop of C0 or C1, wherein the user interface element comprises a rotary knob.

C3. The gas cooktop of C2, wherein the rotary knob comprises a potentiometer.

C4. The gas cooktop of C2, wherein the rotary knob is mechanically coupled to the gas valve.

C5. The gas cooktop of C2, wherein the rotary knob controls a digital output signal.

C6. The gas cooktop of any one of paragraphs C0 through C5, wherein the user interface element comprises a touch screen.

C7. The gas cooktop of any one of paragraphs C0 through C6, wherein the one or more cooling fans are mounted to a range comprising the gas cooktop.

C8. The gas cooktop of any one of paragraphs C0 through C7, wherein the one or more cooling fans are centrifugal fans.

C9. The gas cooktop of any one of paragraphs C0 through C8, wherein the processing logic is further configured to adjust the speed of the one or more cooling fans based on a sensed temperature.

C10. The gas cooktop of any one of paragraphs C0 through C9, wherein the sensed state of the user interface comprises a position of the user interface.

C11. The gas cooktop of any one of paragraphs C0 through C10, wherein the sensed state of the user interface comprises directional information.

C12. The gas cooktop of any one of paragraphs C0 through C11, wherein the sensed state of the user interface comprises a speed of change from one position to another position.

Advantages, Features, and Benefits

The different embodiments and examples of the cooking appliance control system described herein provide several advantages over known solutions for controlling a gas burner. For example, illustrative embodiments and examples described herein allow reliable use of the burner, even at settings wherein the gas pressure is very low or intermittent, without disruption of the burner flame by a cooling fan.

Additionally, and among other benefits, illustrative embodiments and examples described herein allow the burner knob and valve to be mechanically decoupled, resulting in greater freedom in the placement of these components in the appliance.

Additionally, and among other benefits, illustrative embodiments and examples described herein allow a burner valve, burner indicator, cooling fan, and/or other suitable parts of the appliance to be controlled at least partly by the same control system, simplifying the design of the appliance.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A gas cooktop comprising:

a gas burner;

a gas valve controlling a flow of combustible gas to the gas burner;

a user interface (UI) element coupled to the gas valve and operable to change a position of the gas valve; and an electronic controller including processing logic configured to adjust a speed of one or more cooling fans based on a first sensed state of the user interface element, and to subsequently adjust the speed of the one or more cooling fans based on a second sensed state of the user interface element.

2. The gas cooktop of claim 1, wherein the user interface element comprises a rotary knob.

3. The gas cooktop of claim 1, wherein the one or more cooling fans are mounted to a range comprising the gas cooktop.

4. The gas cooktop of claim 1, wherein the processing logic is further configured to adjust the speed of the one or more cooling fans based on a sensed temperature.

5. The gas cooktop of claim 1, wherein the first or second sensed state of the user interface comprises a position of the user interface.

6. The gas cooktop of claim 1, wherein the first or second sensed state of the user interface comprises directional information.

7. The gas cooktop of claim 1, wherein the first or second sensed state of the user interface comprises a speed of change from one position to another position.

8. A control system for a gas cooktop, the system comprising:

a gas burner in fluidic communication with a gas valve configured to throttle a supply of combustible gas to the gas burner;

a user interface element coupled to the gas valve and operable to change a position of the gas valve;

a sensor configured to sense a state of the user interface element;

a controller coupled to the sensor and including processing logic configured to adjust a speed of one or more cooling fans based on a first sensed state of the user interface element, and to subsequently adjust the speed of the one or more cooling fans based on a second sensed state of the user interface element.

9. The system of claim 8, wherein the gas valve comprises a solenoid valve.

10. The system of claim 8, wherein the user interface element comprises a rotary knob coupled to a potentiometer.

11. The system of claim 8, wherein the one or more cooling fans are mounted to a range comprising the gas cooktop.

12. The system of claim 8, wherein the processing logic is further configured to adjust the speed of the one or more cooling fans based on a sensed temperature.

13. The system of claim 8, wherein the first or second sensed state of the user interface comprises a position of the user interface.

14. The system of claim 8, wherein the first or second sensed state of the user interface comprises directional information.

15. The system of claim 8, wherein the first or second sensed state of the user interface comprises a speed of change from one position to another position.

16. A method for operating a gas cooktop, the method comprising:

receiving, by a controller, information corresponding to a first state of a user interface (UI) element, wherein the UI element is configured to control a gas valve coupled to a gas burner of a gas range;

based on the first state of the UI element, adjusting a position of the gas valve;

based on the first state of the UI element, adjusting a speed of one or more cooling fans coupled to the gas range;

receiving, by the controller, information corresponding to a second state of the UI element;

based on the second state of the UI element, adjusting a position of the gas valve; and based on the second state of the UI element, adjusting a speed of one or more cooling fans coupled to the gas range.

17. The method of claim 16, further comprising adjusting the speed of the one or more cooling fans based on a sensed temperature.

18. The method of claim 16, wherein the first or second state of the UI element comprises a setting of the UI element.

19. The method of claim 16, wherein the first or second state of the UI element comprises directional information.

20. The method of claim 16, wherein the first or second state of the UI element comprises a speed of rotation of a mechanical knob.

* * * * *